United States Patent [19]

Butka

[11] Patent Number: 4,679,521

[45] Date of Patent: Jul. 14, 1987

[54] SHIP WITH STABILIZING DEVICE

[76] Inventor: Kemal Butka, 372 Central Park West, New York, N.Y. 10025

[21] Appl. No.: 792,831

[22] Filed: Oct. 25, 1985

[51] Int. Cl.[4] ..... B63B 39/02; B63B 39/06

[52] U.S. Cl. ..... 114/124; 114/126

[58] Field of Search ..... 114/121, 122, 124–126, 114/143

[56] References Cited

U.S. PATENT DOCUMENTS 3,425,384 2/1969 Bell ..... 114/125
3,990,384 11/1976 Reynolds, III ..... 114/126
4,381,725 5/1983 Rowan ..... 114/126

FOREIGN PATENT DOCUMENTS 663452 8/1929 France ..... 114/143

*Primary Examiner*—Sherman D. Basinger
*Attorney, Agent, or Firm*—Michael J. Striker

[57] ABSTRACT

A ship has a whole hull with an inner hollow and a longitudinal axis, and a body which is arranged in the inner hollow of the hull so that when the wind, waves and the like turn the hull in a first lateral direction, the body urges the hull to move in a second lateral direction which is opposite to the first lateral direction so as to stabilize the ship.

7 Claims, 5 Drawing Figures

SHIP WITH STABILIZING DEVICE

BACKGROUND OF THE INVENTION

The present invention relates to a ship, a particularly to such a ship which is provided with means for stabilizing the same.

Ships with stabilizing devices to prevent undesirable movements of the ship during sailing and to stabilize the ship, are known in the art. Such devices are based on sensitive machinery which is designed to respond to the ship movement and take corrective action in form of counteracting movement which is programmed to take place simultaneously with the occurrence of the disturbing movements. Such devices have a common disadvantage that they are very expensive, they require sensitive and expensive units, and they are driven by energy produced by an additional source to be provided on the ship.

SUMMARY OF THE INVENTION

Accordingly, it is an object of the present invention to provide a ship which has a stabilizing system avoiding the disadvantages of the prior art.

More particularly, it is an object of the present invention to provide a ship with a stabilizing system which has a simple construction and operates automatically in response to natural forces which originate from the disturbing movements and therefore does not require a source of additional energy on the ship.

In keeping with these objects and with others which will become apparent herein after, one feature of the present invention resides, briefly stated, in a ship which has a hull, and a body which is arranged in the hull and formed so that when the hull turns about a longitudinal axis in a first lateral direction transverse to the longitudinal axis of the ship, the body urges the hull to move in a second opposite lateral third direction so as to stabilize the ship.

In accordance with one distinctive feature of the present invention, the body is arranged in a support and provided with a guide so that when the hull is turned in the first lateral direction, the body is turned in the second opposite lateral direction to stabilize the ship.

In accordance with a further advantageous feature of the present invention the body is formed so that when the hull is turned in one lateral direction the body moves stabilizing fins so that they move to their extended position to stabilize the ship.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
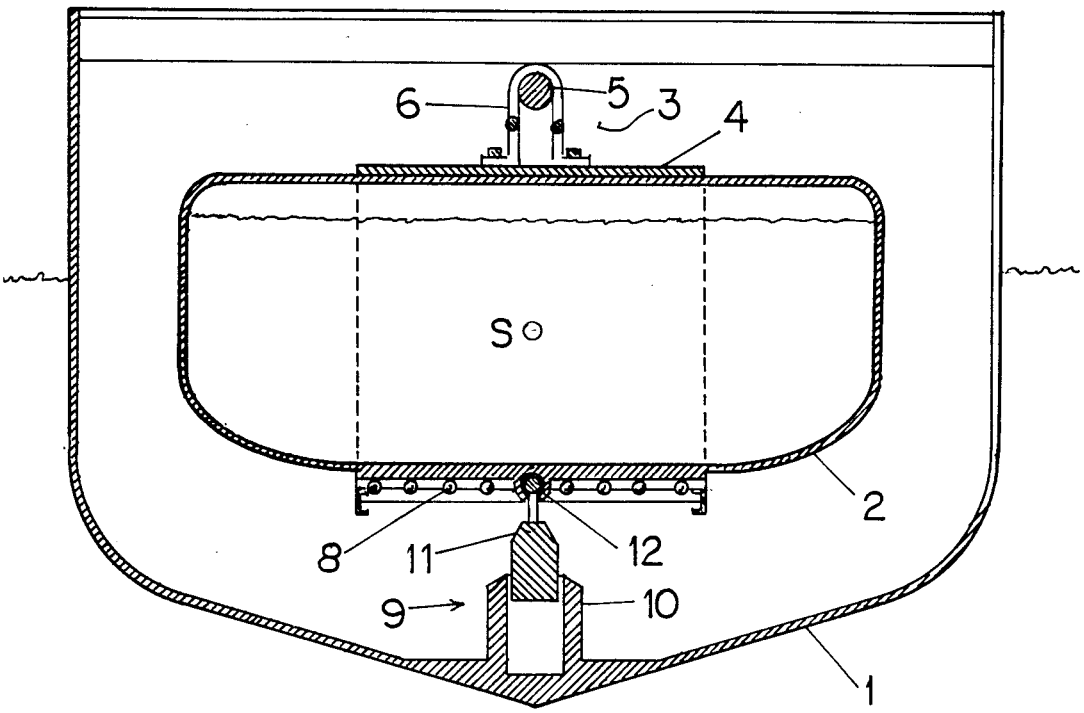
FIG. 1 is a view showing a cross-section of a ship in accordance with the present invention in a normal balanced position.
Figure 2:
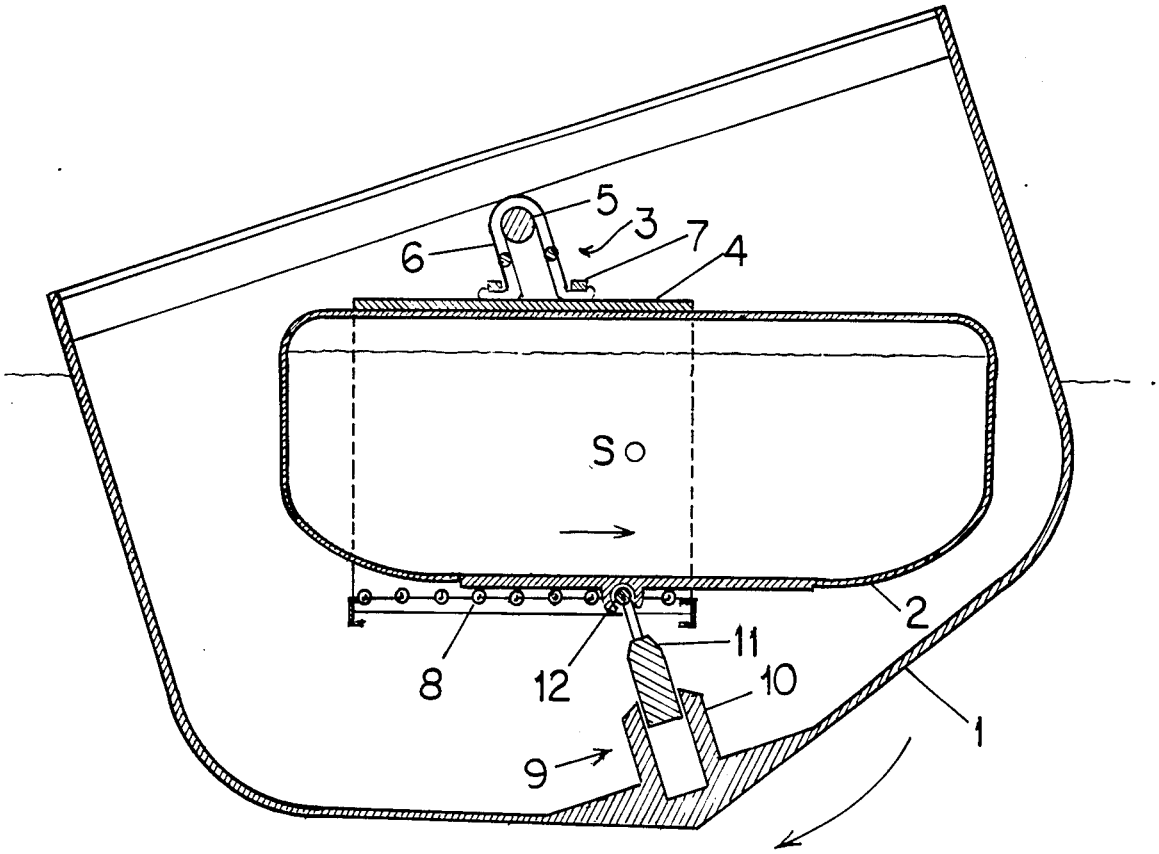
FIG. 2 is a view showing a ship of FIG. 1 in which under the action of waves or wind movement a hull of the ship is inclined.
Figure 3:
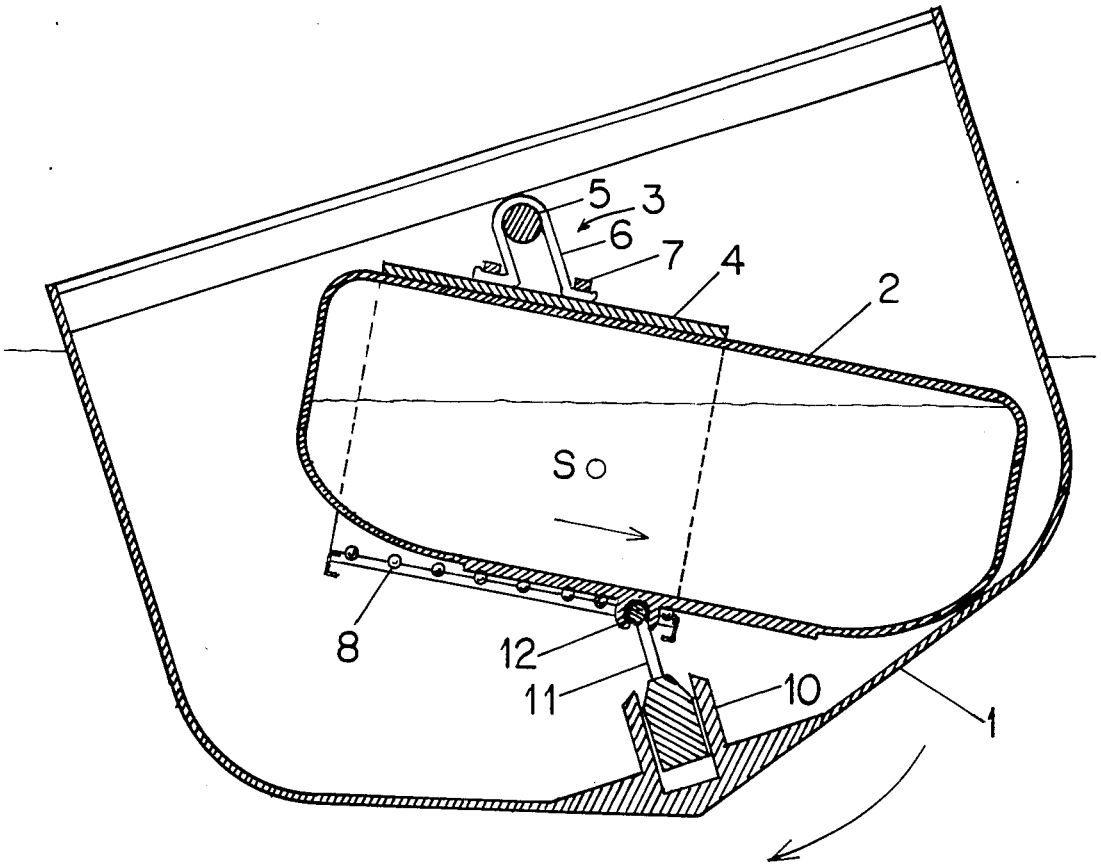
FIG. 3 is a view showing the ship of FIG. 1 in which in the inclined ship of FIG. 2 a body turns to stabilize the ship and to turn the hull.

A ship shown in FIGS. 1–3 has a hull which is identified as a whole with reference numeral 1. A body is provided which can be formed as a solid ballast or a hollow tank 2 filled with water, oil or other liquid.

A supporting device is further provided for supporting the body 2. The supporting device is identified as a whole with reference numeral 3 and has a supporting member 4 which can be formed, for example, as a sleeve. The supporting member 4 is movably suspended on a beam 5 by means of a suspending member 6. A suspending member 6 is bendable and for this purpose can be made of a flexible material. The suspending member 6 is attached to the supporting member 4, for example by screws 7. Ball bearings 8 are arranged in the supporting member 4.

A guiding device is further provided. The guiding device is identified as a whole with reference numeral 9 and has guiding member 10 which is formed as a sleeve. A guiding member 11 is movable in the sleeve 10 and has a free end pivotally connected with the body 2 by a pivot 12.

When waves or wind movement cause turning of the ship to an inclined position shown in FIG. 2 supporting device 3 is displaced laterally in a first direction, for example to the left in FIG. 2, while the guiding device 9 displaces laterally in a second direction opposite to the direction of turning of the hull and away from the center of gravity S. As a result of this the supporting member 4 of the supporting device 3 is inclined in the opposite second lateral direction and the body 2 slides in the supporting member 4 also in the opposite second lateral direction and downwardly. This displacement of the body 2 urges the hull 1 to turn in the second opposite direction and thereby stabilizes the ship.

Figure 4:
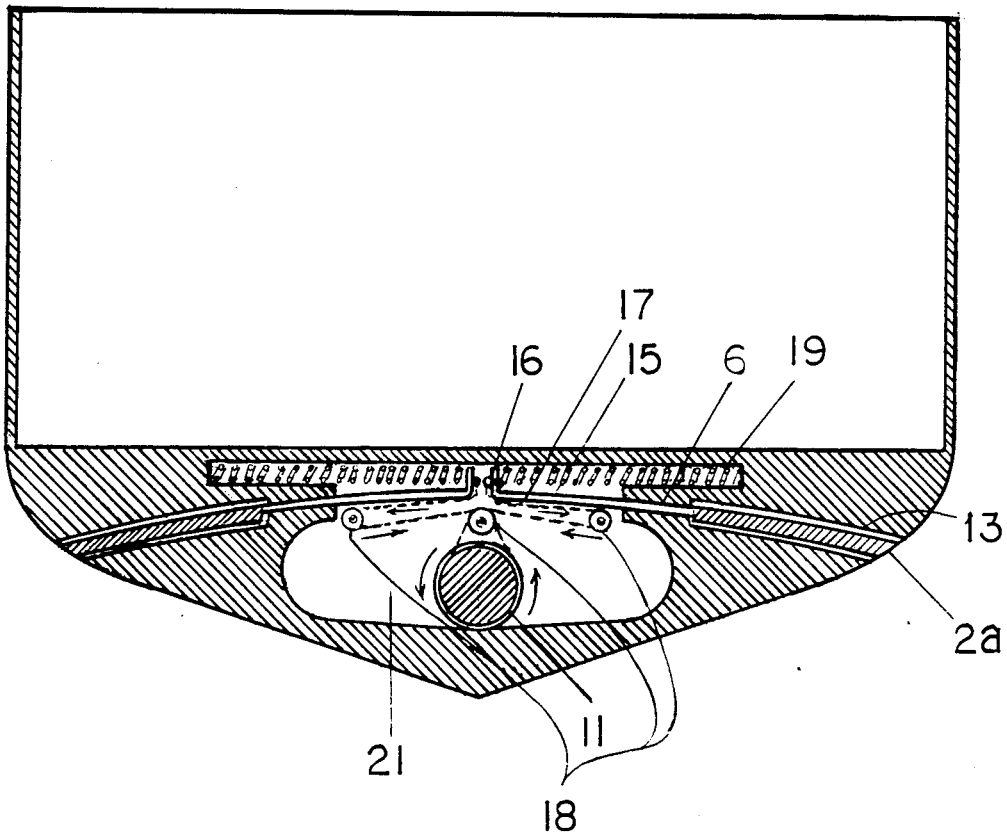
FIG. 4 is a view showing a ship in accordance with another embodiment of the present invention in a normal stabilized position.
Figure 5:
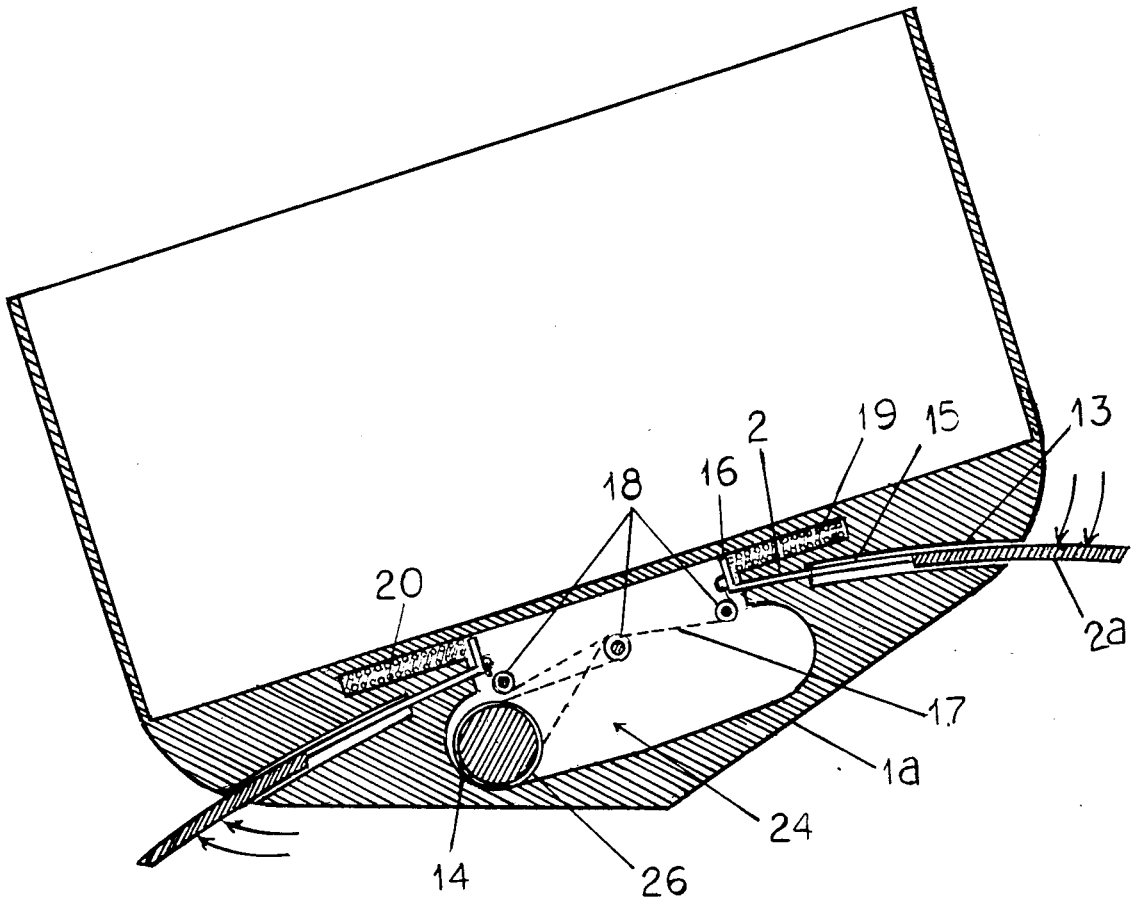
FIG. 5 is a view showing the ship of FIG. 4 in an inclined position.

In a second embodiment shown in FIGS. 4 and 5 a stabilizing element is provided which includes stabilizing fins **2*a*. The stabilizing fins 2*a* are movable in channel 13 formed in a hull 1*a*, between a retracted position shown in FIG. 4 and an extended position shown in FIG. 5. A movable body 26 is formed as a rollable cylinder. It has a groove 14** for example in a central region between its ends.

The stabilizing fins **2*a* are connected with rods each having an outer portion 15, and an inner portion 16 which is bent relative to the outer portion. A transmitting rope 17 is connected with its two ends to the inner portions 16 of the rods and passes around a plurality of rollers 18 and through the groove 14 of the cylinder 26. The inner portions 16 of the rods are spring-biased by springs 19 which are arranged in grooves 20 of the hull 1*a* and urge the stabilizing fins 2*a* to their retracted position. The cylinder 26 is rollable in a passage 21 formed in the hull 1*a***.

When outside forces, such as wind or waves turn the hull in a first lateral direction, for example to the left as shown in FIG. 5, the cylinder 26 is driven by force of gravity to the same lateral side. It applies a pulling action to the rope 17 and pushes the stabilizing fins 2*a* to their extended position so as to stabilize the ship. The springs 19 return the stabilizing fin 2*a* afterwards to their initial retracted position. The fins 2*a* and the outer portions 15 of the rods move in the respective passages of a reduced thickness to prevent a penetration of water into the hull 1*a*.

It will be understood that each of the elements described above, or two or more together, may also find a useful application in other types of constructions differing from the types described above.

While the invention has been illustrated and described as embodied in a ship with stabilizing element, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A ship comprising a hull having an inner hollow and a longitudinal axis; a body located in said inner hollow of said hull and movable in a direction substantially transverse to said longitudinal axis so that when said hull turns about said longitudinal axis in a first lateral direction under the action of waves, wind and the like said body urges to turn said hull back in a second lateral direction which is opposite to said first lateral direction so as to stabilize the ship; and guiding means arranged in said inner hollow of said hull and formed so that when said hull is turned about said longitudinal axis in said first lateral direction, said body is turned in said second lateral direction so as to stabilize the ship, said guiding means including a supporting element arranged for supporting said body and mounted turnably about an axis extending substantially parallel to said longitudinal axis, and a guiding element arranged to guide said body in said supporting element, said supporting element being formed as a sleeve having an inner opening in which said body is slidingly located, said guiding element including a holding member connected with said body and movable in a substantially upright direction while being restrained from movement in a direction transverse to said lateral directions.

2. A ship as defined in claim 1; and further comprising an axle which forms said axis of turning of said supporting element and is mounted in said hull, and a flexible connecting member arranged to suspend said supporting element on said axle.

3. A ship comprising a hull having an inner hollow and a longitudinal axis, said hull also having a recess extending in a direction which is transverse to said longitudinal axis; a cylindrical body located in said recess of said hull and rollable in said recess in a direction substantially transverse to said longitudinal axis; stabilizing fins arranged in said hull at both sides of said longitudinal axis and movable between an extended and a retracted position; and a flexible connecting member which connects said cylindrical body with said fins so that when said hull is turned in a lateral direction, said cylindrical body is rolled in said recess and displaces said stabilizing fins to said extended position so as to stabilize the ship.

4. A device as defined in claim 3; and further comprising a plurality of rollers, said flexible member connected with said stabilizing fins passing over said rollers and being connected with said body.

5. A ship as defined in claim 3; and further comprising means for returing said stabilizing fins from said extended position to said retracted position.

6. A ship as defined in claim 5, wherein said returning means include springs arranged in said hull and urging said stabilizing fins to move from said extended position to said retracted position.

7. A ship as defined in claim 3, wherein said flexible connecting member is a rope-like member.

* * * * *